US009154881B2

(12) United States Patent
Gautama et al.

(10) Patent No.: US 9,154,881 B2
(45) Date of Patent: Oct. 6, 2015

(54) DIGITAL AUDIO PROCESSING SYSTEM AND METHOD

(71) Applicant: NXP B.V., Eindhoven (NL)

(72) Inventors: Temujin Gautama, Boutersem (BE); Alan Ocinneide, Brussels (BE)

(73) Assignee: NXP B.V., Eindhoven (NL)

( * ) Notice: Subject to any disclaimer, the term of this patent is extended or adjusted under 35 U.S.C. 154(b) by 250 days.

(21) Appl. No.: 13/973,739

(22) Filed: Aug. 22, 2013

(65) Prior Publication Data

US 2014/0072123 A1 Mar. 13, 2014

(30) Foreign Application Priority Data

Sep. 13, 2012 (EP) ..... 12184320

(51) Int. Cl.
*H04R 5/04* (2006.01)
*G10L 19/005* (2013.01)

(52) U.S. Cl.
CPC ..... *H04R 5/04* (2013.01); *G10L 19/005* (2013.01)

(58) Field of Classification Search
None
See application file for complete search history.

(56) References Cited

U.S. PATENT DOCUMENTS

| | | | | |
|---|---|---|---|---|
| 6,351,728 | B1 * | 2/2002 | Wiese et al. | 704/201 |
| 6,421,802 | B1 * | 7/2002 | Schildbach et al. | 714/747 |
| 6,490,551 | B2 | 12/2002 | Wiese et al. | |
| 2004/0039464 | A1 * | 2/2004 | Virolainen et al. | 700/94 |

FOREIGN PATENT DOCUMENTS

| | | | |
|---|---|---|---|
| DE | 101 39 247 | A1 | 3/2003 |
| WO | 2005/059898 | A1 | 6/2005 |

OTHER PUBLICATIONS

Lauber, P. et al. "Error Concealment for Compressed Digital Audio", In Proc. 111th AES Convention, pp. 1-11 (Sep. 2001).
Loizou, P. "Speech Enhancement: Theory and Practice, Chapter 5—Spectral-Subtractive Algorithns", 1st Edition. CRC Press, 23 pgs. (2007).
Fitzgerald, D. "Harmonic/Percussive Separation Using Median Filtering", Proc. of 13th Intl. Conf. Digital Audio Effects, pp. DAFX 1-4 (2010).
Zhu, M. et al. "Streaming Audio Packet Loss Concealment Based on Sinusoidal Frequency Estimation in MDCT Domain", IEEE Trans. on Consumer Electronics, vol. 56, No. 2, pgs. 811-819 (May 2010).
Extended European Search Report for EP Patent Appln. No. 12184320.5 (Dec. 13, 2012).

* cited by examiner

*Primary Examiner* — Brenda Bernardi

(57) ABSTRACT

Systems and method for audio processing are disclosed. Left and right channels of an audio data stream are combined to derive sum and difference signals. A time domain to frequency domain converter is provided for converting the sum and difference signals to the frequency domain. a first processing unit is provided for deriving a frequency domain noise signal based at least partly on the frequency domain difference signal. A second processing unit is provided for processing the frequency domain sum signal using the noise signal thereby to reduce noise artifacts in the sum signal. A frequency domain to time domain converter is provided for converting at least the processed frequency domain sum signal to the time domain.

15 Claims, 4 Drawing Sheets

DIGITAL AUDIO PROCESSING SYSTEM AND METHOD

CROSS-REFERENCE TO RELATED APPLICATIONS

This application claims the priority under 35 U.S.C. §119 of European patent application no. 12184320.5, filed on Sep. 13, 2012, the contents of which are incorporated by reference herein.

This invention relates to digital audio systems, such as digital radio, and is concerned particularly with reducing bit-error-related audio artifacts.

In digital audio signal transmissions over error-prone channels (such as digital radio), the received (encoded) signals may contain bit errors. The number of bit errors increases as the reception quality deteriorates. If the bit errors are still present after all error detection and error correction methods have been applied, the corresponding audio frame may not be decodable anymore and is "corrupted" (either completely or only in part).

One way of dealing with these errors is to mute the audio output for a certain period of time (e.g., during one or more frames). More advanced error concealment strategies (repetition, left-right substitution and estimation) are described in U.S. Pat. No. 6,490,551.

In these approaches, the corrupted signal sections are detected, after which they are replaced by signal sections from the same channel or an adjacent channel. The signal sections may be replaced completely or only one or several frequency bands may be replaced.

An additional approach is that of noise substitution, where an audio frame may be replaced by a noise frame, the spectral envelope of which may be matched to that expected from the audio frame. This approach is described in Lauber, P et al.: "Error concealment for compressed digital audio" In: Proceedings of the 111th AES Convention, New York. Paper number 5460, September 2001.

In the presence of bit errors, audible artifacts can be present in the decoded audio signals, either due to the bit errors themselves, or due to the error concealment strategies that have been applied.

In current state-of-the-art systems, the error concealment strategies improve the decoded audio signals, but in many cases, these annoying artifacts are still present. While muting content is one way to avoid these artifacts being audible, it would be desirable to be able to lower the audible artifacts, without muting the content.

According to the invention, there is provided a method and apparatus as defined in the independent claims.

In one aspect, the invention provides an audio processing system, comprising:

combining means for combining left and right channels of an audio data stream to derive sum and difference signals;

a time domain to frequency domain converter for converting the sum and difference signals to the frequency domain;

a first processing unit for deriving a frequency domain noise signal based at least partly on the frequency domain difference signal;

a second processing unit for processing the frequency domain sum signal using the noise signal thereby to reduce noise artifacts in the sum signal; and a frequency domain to time domain converter for converting at least the processed frequency domain sum signal to the time domain.

The invention provides a method to attenuate audible artifacts in a degraded audio signal.

The invention is based on the recognition that a stereo signal will have different bit-error-related artifacts on the left and the right channels, since the left and right signals are (at least partially) encoded independently. A noise reference is derived at least from the difference between the left and the right signal, and is used to enhance the audio signal in the frequency domain.

The first processing unit can derive an interchannel coherence function between the frequency domain sum signal and the frequency domain difference signal. This provides a way of distinguishing between noise and signal content. The frequency domain sum signal can be multiplied by the interchannel coherence function and the multiplication result can then be subtracted from the frequency domain difference signal to derive the noise signal.

In another approach, the first processing unit can separate the frequency domain difference signal into harmonic and percussive components. This provides another way of distinguishing between noise and signal content. The first processing unit can then combine the harmonic and percussive components with a weighting factor to derive the noise signal. The weighting factor can be controlled by a control signal which is a measure related to the quality of the audio data stream.

In one implementation, the system derives a processed sum signal as a mono output. In another implementation, the system can derive a stereo output comprising processed left and right channels. The processed left and right channels can be derived from processed frequency domain sum and difference signals. The processed difference signal can be based on the harmonic component.

The second processing unit preferably performs a spectral subtraction of the frequency domain noise signal from the frequency domain sum signal to derive the processed sum signal.

In another aspect, the invention provides an audio processing method, comprising:

combining left and right channels of an audio data stream to derive sum and difference signals;

converting the sum and difference signals to the frequency domain;

deriving a frequency domain noise signal based at least partly on the frequency domain difference signal;

processing the frequency domain sum signal using the noise signal thereby to reduce noise artifacts in the sum signal; and converting at least the processed frequency domain sum signal to the time domain.

The invention can be implemented as a computer program comprising code means which when run on a computer implements the method of the invention.

An example of the invention will now be described in detail with reference to the accompanying drawings, in which.

The invention provides an audio processing system in which a noise signal is obtained based at least partly on a difference between the left and right channels. This noise signal is a reference which is used for processing the audio stream to reduce noise artifacts in the audio stream.

The invention is based upon the observation that the left and right channels of a stereo signal are encoded independently, at least partly, and this enables a noise reference to be derived from the differences between the left and right signals.

In the DAB standard (ETSI, 2006), there is the possibility to encode a stereo signal as an independent left and right channel ("stereo mode") or only the lower frequencies as independent channels with independent scale factors and subband data, and the high frequencies using independent scale factors but sharing the same subband data ("joint stereo mode").

If one or several bit errors occur in the independently encoded channels (or in the parts that are independently encoded), the resulting artifacts in the decoded audio signal will also be uncorrelated across the channels. Therefore, the presence of bit errors in an encoded stereo signal can result in audio artifacts that are uncorrelated across channels.

This invention aims to reduce the artifacts introduced by bit errors in the subband data, which consists of the time signals for each of the frequency subbands by processing the stereo audio signal (thus, after the bitstream has been decoded).

Figure 1:
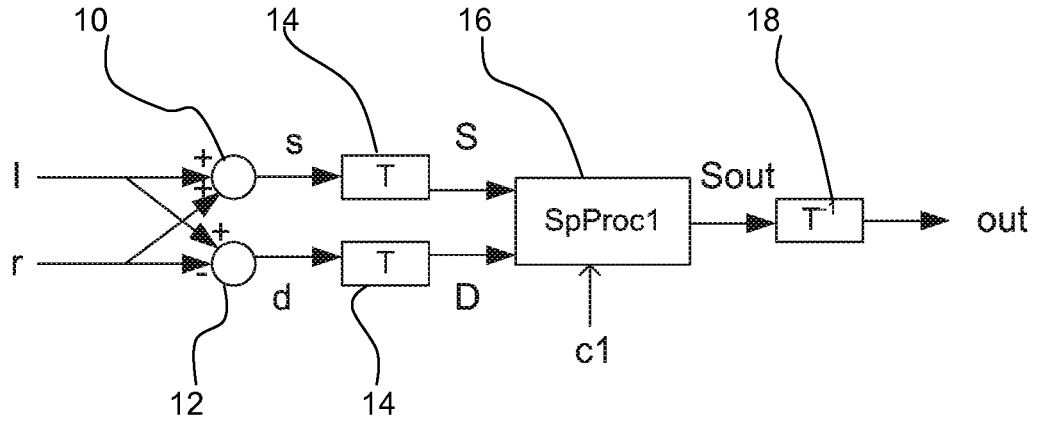
FIG. 1 shows a first example of processing system of the invention.

A first embodiment is shown in FIG. 1.

As a first step, the left ("l") and right ("r") channels are combined into a sum ("s", (l+r/2) and difference ("d", (l−r)/2) signal. An adder 10 and a subtractor 12 are shown to perform the combinations, and it is noted that the division by 2 has not been included in FIG. 1.

The sum and difference signals are transformed by transforming units 14 to the frequency domain, and the resulting complex-valued frequency spectra are processed by a spectral processing module 16 ("SpProc1"), which further receives a control signal c1, which is a measure of the reception quality and therefore the expected audio quality of the DAB audio signal.

The processing module 16 determines a noise reference, the presence of which is then reduced in the sum signal by using a spectral subtraction approach. The result ("Sout") is transformed to the time domain by transforming unit 18 ("$T^{-1}$"), yielding the (mono) output signal "out".

The method can be applied to the complete stereo signal, or only to a particular frequency region. For example the stereo signal can be divided into two frequency bands, below and above 6 kHz, and only the lower frequency band is processed. In the remainder of the text, the 'clean' difference signal, i.e., the difference signal when there would be no bit errors present (possibly not available), is referred to as the stereo content, whereas the noisy difference signal is referred to simply as the difference signal.

Spectral subtraction is a well-known method used for noise reduction by reducing the presence of an interference (in this case, the noise reference, N(ω)) in the input signal (in this case, the sum signal, S(ω)). In particular, a real-valued gain function, $G_1(\omega)$, can be computed for this purpose. For more details, reference is made to Loizou, P., 2007. Speech Enhancement: Theory and Practice, 1st Edition. CRC Press, and Chapter 5 in particular:

$$G_1(\omega) = \sqrt{\frac{|S(\omega)|^2 - \gamma_1|N(\omega)|^2}{|S(\omega)|^2}}, \tag{1}$$

where $\gamma_1$ is an oversubtraction factor. When |N(ω)| is inaccurately estimated, $\gamma_1$ can be set to a value greater than 1 to compensate.

Note that this is only one example of a gain function, and others are possible. The gain function (or a temporally smoothed version) is applied to the input signal to obtain the complex-valued output spectrum:

$$Sout(\omega)=S(\omega)G_1(\omega). \tag{2}$$

The oversubtraction factor, $\gamma_1$ in Eq. (1), determines how aggressive the spectral subtraction is. It can be fixed, or it can optionally be made variable so that it is a function of a control signal c1, which is related to the expected audio quality of the sum signal (signal-to-artifact ratio).

This can be achieved for example by making the control signal, c1, equal to the bit-error rate (BER), or to the occurrence rate of incorrect frames (due to header or scalefactor errors), or to the reception quality, or to another related measure or combination thereof.

The noise reference, N(ω), is an estimate of the undesired interference that is present in the sum signal, and it can be obtained from the difference signal. Indeed, since the artifacts on the left and right channel are uncorrelated, the artifacts from both channels are present both on the sum and on the difference signals (possibly with an inverted phase).

Assume that there is no stereo content, the noisy difference signal consists only of the audio artifacts. In that case, it can be used as a noise reference as such (note that a possibly inverted phase is not important for spectral subtraction, since only the amplitude spectrum of the noise reference is taken into account in the computation of the gain function).

If the audible artifacts are stronger in power than the stereo content, the difference signal can also be used as a noise reference as such. However, there will be a slight attenuation of certain frequencies in the mono signal, namely those frequencies where the stereo content is non-zero.

If the stereo content is stronger in power than the artifacts, the difference signal can no longer be used as a noise reference as such. Indeed, there can be a strong attenuation of certain frequencies in the mono signal, namely those frequencies where the stereo content is stronger than the audio artifacts.

To prevent the attenuation of certain frequencies in the mono signal, the magnitude of the stereo content in the noise reference needs to be reduced. This can be done in several ways.

Figure 2:
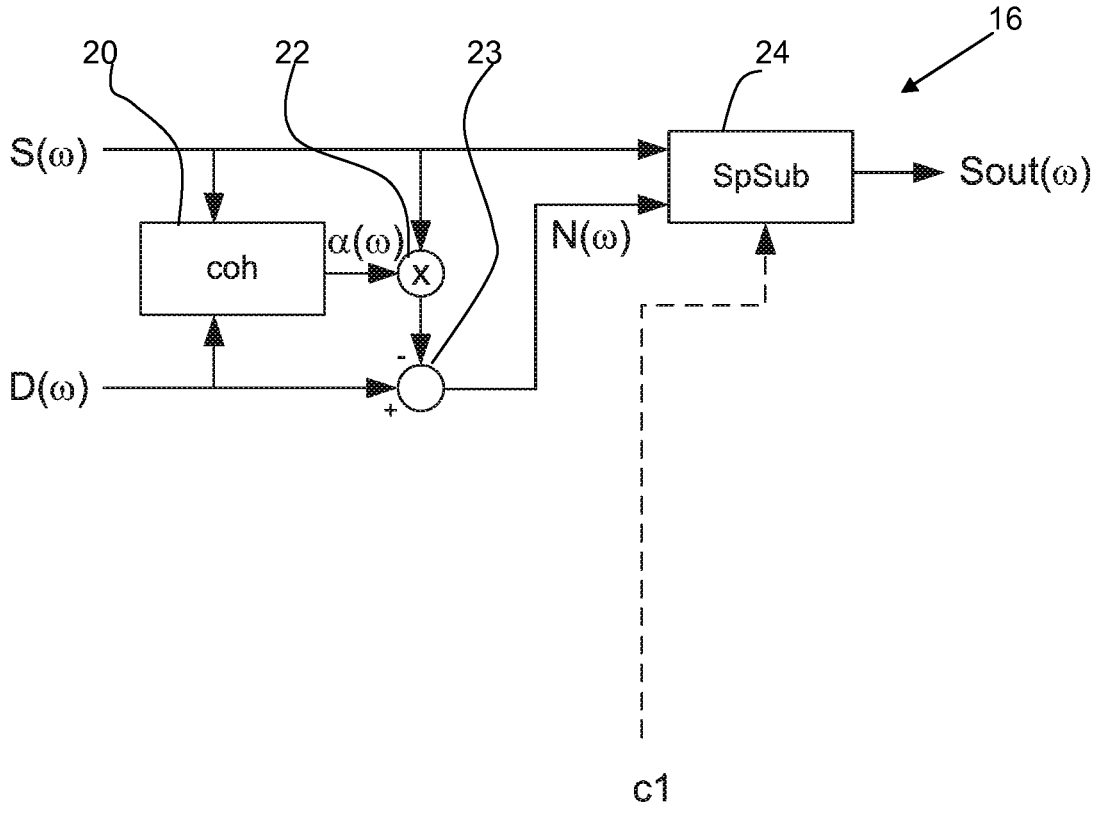
FIG. 2 shows in schematic form a first implementation of the processor module of the FIG. 1.

FIG. 2 shows in schematic rendition form a first implementation of the processor module 16 of FIG. 1.

The processor 16 is designed to estimate the interchannel coherence function, α(ω), between the sum and difference signals:

$$\alpha(\omega) = \frac{|S(\omega)D(\omega)^*|}{|S(\omega)||D(\omega)|}, \tag{3}$$

where * denotes the complex conjugate.

The coherence function is obtained by the processing unit 20.

To make the estimate of the coherence more robust, it can be smoothed across time. Using the interchannel coherence function, the expected stereo content can be subtracted from the difference signal to obtain the noise reference:

$$N(\omega)=D(\omega)-\alpha(\omega)S(\omega). \tag{4}$$

This multiplication is shown by multiplier 22 and the subtraction is shown by subtractor 23.

The noise reference is then spectrally subtracted from the sum signal in the subtracting unit 24 ("SpSub"), which has an oversubtraction factor controlled by control signal c1.

This signal c1 is a measure of the reception quality, such as a bit-error rate (BER), or a measure of the occurrence rate of incorrect frames (due to header or scalefactor errors), or another related measure.

Figure 3:
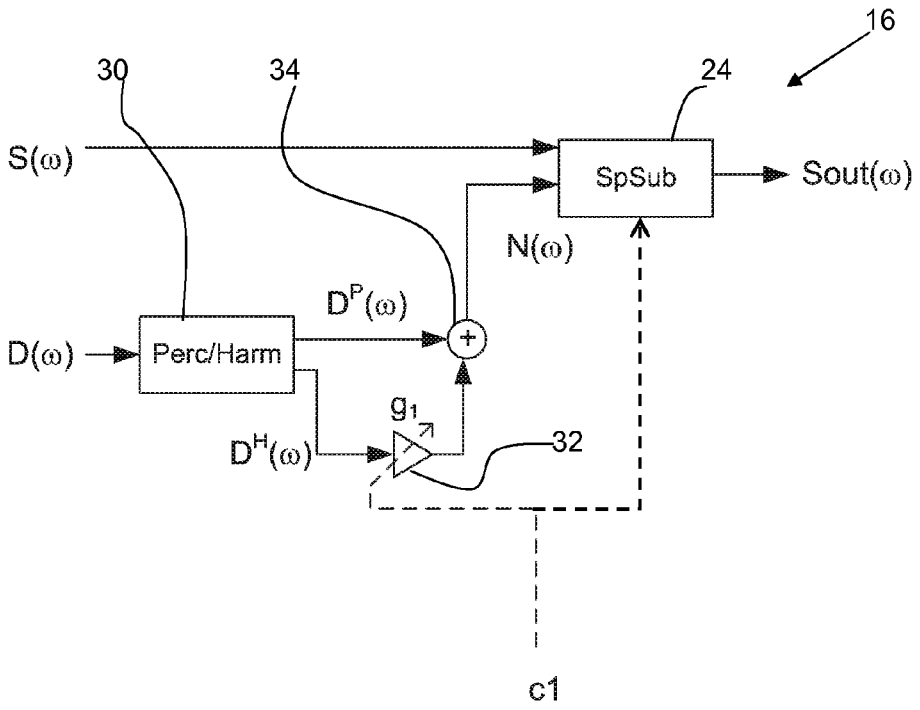
FIG. 3 shows in: schematic form a second implementation of the processor of FIG. 1.

FIG. 3 shows in schematic form of a second implementation of the processor of FIG. 1.

This circuit is based on the separation of the valid signal stereo information from the bit-error-related artifacts using distinguishing characteristics of these artifacts. As the artifacts are often non-stationary in time and frequency, it is possible to use this property to isolate them from the stereo content.

Fitzgerald, D., 2010. Harmonic/percussive separation using median filtering. In: Proceedings of the 13th International Conference on Digital Audio Effects DAFX, Graz, Austria describes a method to estimate a percussive mask, $G^P(\omega)$, which attenuates the harmonic content and emphasises the percussive content, and a harmonic mask, $G^H(\omega)$, which attenuates the percussive content and emphasises the harmonic content. Note that other methods that distinguish between stationary and nonstationary components of a signal can be used as well.

The circuit has a percussive mask 30. Since the bit-error-related artifacts are non-stationary in nature (present in one frame and absent in the next), they will be captured by the percussive mask. Therefore, the noise reference starts from the application of the percussive mask to the difference signal, yielding $D^P(\omega)$. When the reception quality is very poor and the frequency of bit errors increases, the separation between stationary and nonstationary sounds may fail, due to which not all artifacts are captured by the percussive mask. In these cases, a measure of the reception quality (or a related measure) can be used to control the balance of harmonic and percussive components which form the noise estimate. Application of the harmonic mask to the difference signal yields $D^H(\omega)$. A possible method is to compute the noise reference in the following manner:

$$N(\omega)=D^P(\omega)+g_1D^H(\omega) \tag{5}$$

where $g_1$ is a factor between 0 and 1 that is controlled by a control signal c1, which is a measure of the reception quality (or a related measure) and that is near 1 when the reception quality is very low. This way, possible artifacts that are not captured by the percussive mask are still subtracted at the cost of possible attenuation of the sum signal. The control signal c1 in FIG. 3 is the same as the control signal in FIG. 2 as discussed above.

The variable gain unit 32 implements the gain factor control, and the summation in Equation (5) is implemented by the adder 34.

The noise reference is then spectrally subtracted (Eq. (1)) from the sum signal in unit 24, with the oversubtraction factor controlled by control signal c1.

The two examples above each provide a (mono) sum signal at the output, which has had the noise component subtracted from it, by processsing in the frequency domain.

Figure 4:
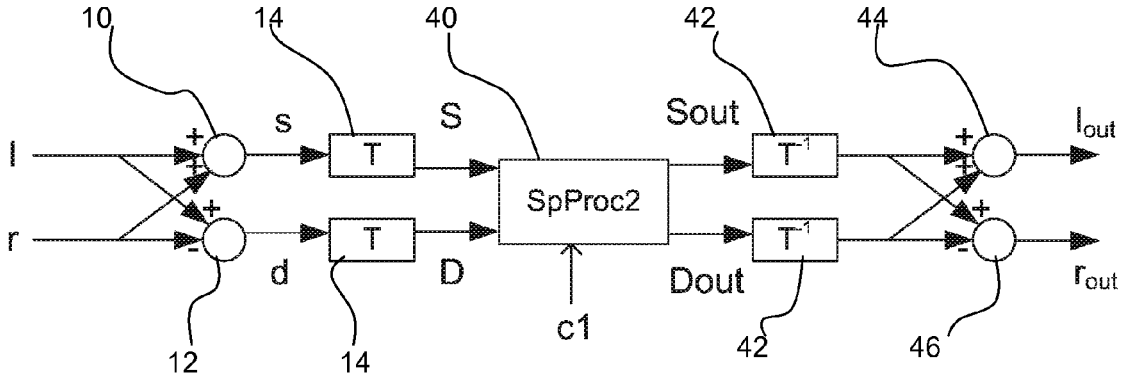
FIG. 4 shows a second example of processing system of the invention.

A second embodiment is shown in FIG. 4 in which a stereo ouptut is provided.

The same adder, subtractor and first transformation units 10,12,14 are used as in FIG. 1.

The spectral processing module 40 ("SpProc2") now has two outputs, namely a processed sum signal ("Sout") and a processed difference signal ("Dout"), and it is again controlled by the control signal c1.

Both output signals are transformed to the time domain by transformation units 42, after which the left and right output signals ("lout" and "rout") are computed from the sum and difference of the processed sum and difference signals. An adder 44 and subtractor 46 are shown for this purpose.

This second embodiment retains the stereo information as well as possible, rather than reverting to mono (as in the first embodiment). In this embodiment, the spectral processing module 40 reduces the bit-error-related artifacts not only in the sum signal, but also in the difference signal.

Figure 5:
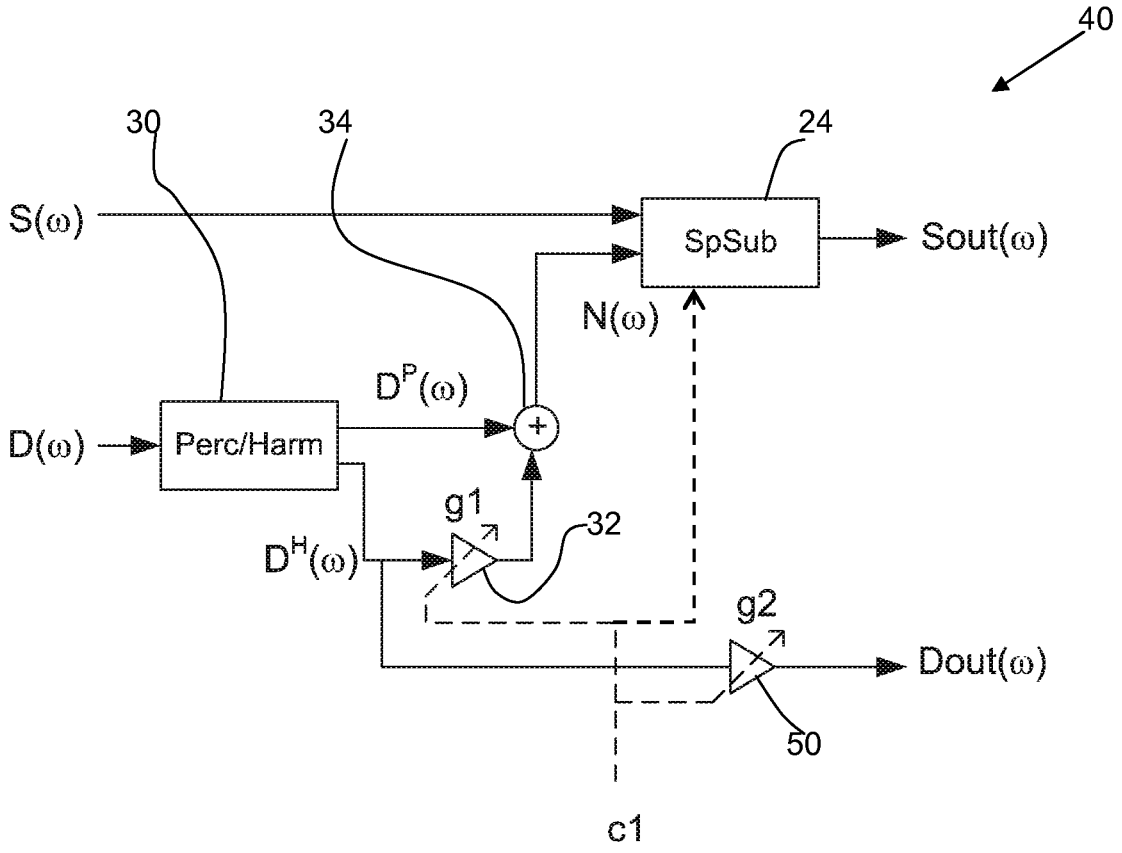
FIG. 5 shows a block diagram of the processing module of the system of FIG. 4.

FIG. 5 shows a block diagram of the processing module 40. The inputs are frequency bins of the sum and difference spectra ($S(\omega)$ and $D(\omega)$) and the control signal c1.

The system of FIG. 5 is based on the separation of the difference signal into into stationary and non-stationary components as explained in connection with FIG. 3. FIG. 5 differs from FIG. 3 in that the difference signal after application of the harmonic mask (signal $D^H(\omega)$) is passed through a second amplifier 50 with gain g2 to derive the processed difference output signal $Dout(\omega)$.

Thus, from the difference signal, the percussive and harmonic parts are separated (e.g., using the approach described in Fitzgerald, 2010), yielding $D^P(\omega)$ and $D^H(\omega)$. The noise reference is obtained and subtracted from the sum signal in the same manner as in the first embodiment, whereas the difference signal is derived from the identified harmonic component.

The processed difference signal is obtained by scaling the harmonic part of the difference signal with the factor $g_2$. This factor is also controlled by the control signal c1, and is near 0 (no stereo content in the output) when the reception quality is very poor.

Figure 6:
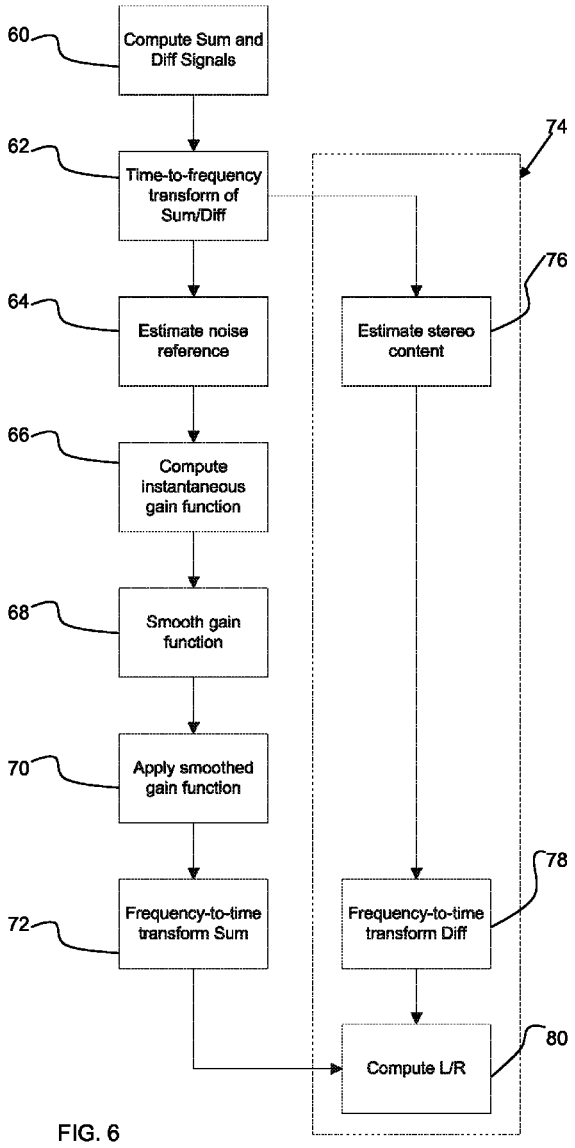
FIG. 6 is a flow-chart of the process of the invention.

For the sake of completeness, a flow-chart of one example of the process is included in FIG. 6.

The process comprises the computation of the sum and difference signals, s and d in step 60. These are transformed to the frequency domain in step 62 to derive signals $S(\omega)$ and $D(\omega)$.

The noise reference $N(\omega)$ is estimated in step 64, and the gain function is computed in step 66, which is based on the signal reception quality measure c1. This gain function is (optionally) smoothed in step 68. The spectral subtraction function is applied in step 70. Finally, step 72 provides conversion back to the time domain and the result is the time domain processed sum signal.

These steps essentially correspond to FIG. 2, and it will be appreciated that the version of FIG. 3 will have the gain function applied as part of the estimation of the noise function.

The additional steps needed to enable a stereo output, as provided by the second implementation, are delimited by the dashed rectangle 74. This involves additionally estimating the stereo difference content from the frequency domain sum and difference signals in step 76 and converting to the time domain in step 78. From the two time domain signals, the left and right signals can be derived in step 80.

The proposed invention can be implemented as a software module. The preferred implementation uses the following components:

- a decoded stereo signal, the left and right channels of which have been (partly) encoded independently,
- a transform from time to frequency domain
- a means for generating the noise reference, based on the difference signal
- a means for processing using the noise signal, such as spectral subtraction optionally a control signal that is a measure of the bit-error rate (BER), or of the occurrence rate of incorrect frames (due to header or scalefactor errors), or of the reception quality, or another related measure a transform from frequency to time domain The invention can be implemented as a software module that processes the stereo output signals of a decoder (DAB or other). It can be implemented as part of a digital radio receiver.

By implementing the invention, the artifacts that are present in the stereo output signal are reduced compared to the input stereo signal in scenarios where bit errors are expected to degrade the audio quality. The output signal will have more attenuation in frequency regions where the stereo content is strongly non-stationary and high in power.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. An audio processing system, comprising:

combining means for combining left and right channels of an audio data stream to derive sum and difference signals;

a time domain to frequency domain converter for converting the sum and difference signals to the frequency domain;

a first processing unit for deriving a frequency domain noise signal based at least partly on the frequency domain difference signal;

a second processing unit for processing the frequency domain sum signal using the noise signal thereby to reduce noise artifacts in the sum signal; and a frequency domain to time domain converter for converting at least the processed frequency domain sum signal to the time domain.

2. A system as claimed in claim 1, wherein the first processing unit derives an interchannel coherence function, between the frequency domain sum signal and the frequency domain difference signal.

3. A system as claimed in claim 2, comprising a multiplier for multiplying the frequency domain sum signal by the interchannel coherence function and a subtractor for subtracting the multiplication result from the frequency domain difference signal to derive the noise signal.

4. A system as claimed in claim 1, wherein the first processing unit separates the frequency domain difference signal into harmonic and percussive components.

5. A system as claimed in claim 4, wherein the first processing unit is adapted to combine the harmonic and percussive components with a weighting factor to derive the noise signal.

6. A system as claimed claim 5, wherein the weighting factor is controlled by a control signal which is a measure related to the expected audio quality of the audio data stream.

7. A system as claimed in claim 1, wherein:

the system derives a processed sum signal as a mono output; or the system derives a stereo output comprising processed left and right channels, wherein the processed left and right channels are derived from processed frequency domain sum and difference signals, the processed difference signal being based on the harmonic component.

8. A system as claimed in claim 1, wherein the second processing unit performs a spectral subtraction of the frequency domain noise signal from the frequency domain sum signal.

9. A system as claimed in claim 8, wherein the spectral subtraction is controlled based on a control signal which is a measure related to the expected audio quality of the audio data stream.

10. An audio processing method, comprising:

combining left and right channels of an audio data stream to derive sum and difference signals;

converting the sum and difference signals to the frequency domain;

deriving a frequency domain noise signal based at least partly on the frequency domain difference signal;

processing the frequency domain sum signal using the noise signal thereby to reduce noise artifacts in the sum signal; and converting at least the processed frequency domain sum signal to the time domain.

11. A method as claimed in claim 10, comprising deriving an interchannel coherence function, between the frequency domain sum signal and the frequency domain difference signal, multiplying the frequency domain sum signal by the interchannel coherence function and subtracting the multiplication result from the frequency domain difference signal to derive the noise signal.

12. A method as claimed in claim 10, comprising separating the frequency domain difference signal into harmonic and percussive components, and combining the harmonic and percussive components with a weighting factor to derive the noise signal.

13. A method as claimed in claim 12, comprising deriving a stereo output comprising processed left and right channels derived from processed frequency domain sum and difference signals, wherein the processed difference signal is based on the harmonic component.

14. A method as claimed in claim 10, wherein processing the frequency domain sum signal comprises performing a spectral subtraction of the frequency domain noise signal from the frequency domain sum signal.

15. A non-transitory computer readable medium including programming instructions, which when executed by a processor implements an audio processing operation, the operation includes:

combining left and right channels of an audio data stream to derive sum and difference signals;

converting the sum and difference signals to the frequency domain;

deriving a frequency domain noise signal based at least partly on the frequency domain difference signal;

processing the frequency domain sum signal using the noise signal thereby to reduce noise artifacts in the sum signal; and converting at least the processed frequency domain sum signal to the time domain.

* * * * *